US007971917B2

(12) United States Patent
Ge

(10) Patent No.: US 7,971,917 B2
(45) Date of Patent: Jul. 5, 2011

(54) APPARATUS FOR AN AUTOMATIC CASING STABBING ARM

(76) Inventor: Yaogen Ge, Katy, TX (US)

( * ) Notice: Subject to any disclaimer, the term of this patent is extended or adjusted under 35 U.S.C. 154(b) by 335 days.

(21) Appl. No.: 12/195,474

(22) Filed: Aug. 21, 2008

(65) Prior Publication Data

US 2009/0053014 A1 Feb. 26, 2009

Related U.S. Application Data

(60) Provisional application No. 60/965,481, filed on Aug. 21, 2007.

(51) Int. Cl.
*B25J 15/02* (2006.01)

(52) U.S. Cl. ..... 294/88; 294/115; 166/85.1; 81/57.16; 81/57.24; 81/57.34; 269/249

(58) Field of Classification Search ..... 294/88, 294/115, 902, 905; 166/77.51, 85.5, 85.1; 414/22.53, 22.54, 22.55, 450, 453, 739, 741; 81/57.15, 57.16, 57.2, 57.24, 57.33–57.34; 269/249, 143

See application file for complete search history.

(56) References Cited

U.S. PATENT DOCUMENTS

| | | | | |
|---|---|---|---|---|
| 4,234,150 | A | 11/1980 | Mee et al. | |
| 4,652,195 | A * | 3/1987 | McArthur | 414/22.51 |
| 4,810,019 | A * | 3/1989 | Brucher | 294/106 |
| 5,049,020 | A | 9/1991 | McArthur | |
| 5,062,756 | A * | 11/1991 | McArthur et al. | 414/22.51 |
| 5,092,731 | A * | 3/1992 | Jones et al. | 414/406 |
| 7,076,852 | B2 * | 7/2006 | Penman et al. | 29/426.5 |
| 7,140,445 | B2 * | 11/2006 | Shahin et al. | 166/380 |
| 7,178,612 | B2 | 2/2007 | Belik | |
| 7,191,686 | B1 * | 3/2007 | Angelle et al. | 81/57.34 |
| 7,509,722 | B2 * | 3/2009 | Shahin et al. | 29/407.09 |

* cited by examiner

*Primary Examiner* — Saúl J Rodríguez
*Assistant Examiner* — Stephen Vu
(74) *Attorney, Agent, or Firm* — Ronald E. Greigg

(57) ABSTRACT

The apparatus for an automated drill pipe casing stabbing arm includes a telescopic tube assembly, a movable roller bracket assembly, a movable arm assembly, a mounting assembly, an apparatus actuator, and a PLC portable remote control device. An actuator mechanism positions the gripping arm assembly and the roller bracket assemble relative to one another in order to capture and grip the casing therebetween to support and grip the casing on the circumference thereof from opposing diametric sides. The automated stabbing arm is installed on a rig's mast or derrick. In a working position, the apparatus is oriented horizontally to provide radial support and guidance to the casing. A rig worker on the rig floor controls the apparatus by the portable remote control device.

19 Claims, 4 Drawing Sheets

APPARATUS FOR AN AUTOMATIC CASING STABBING ARM

CROSS REFERENCE TO RELATED APPLICATION

This application is based on U.S. Provisional Patent Application Ser. No. 60/965,481 filed on Aug. 21, 2007.

FIELD OF THE INVENTION

The invention is an automated stabbing arm which is used for guiding and supporting a drill pipe casing during a drill pipe stabbing operation on a drill rig or derrick.

BRIEF DESCRIPTION OF THE PRIOR ART

Various types of apparatus have been provided to assist in the manual alignment and interconnection of sections of elongated drill pipe and other tubular stock used in drilling and completion of oil and gas wells. Most of these devices employ mechanical advantage, and in many cases hydraulics, to cause a pair of gripping elements or tongs to surround and engage the tubular stock, and then to use leverage or hydraulics to position the tubular stock to a precise position within a derrick and generally immediately over the well head at which a second section of the tubular stock located. The manipulation described is used to position the upper section of tubular stock over the one suspended in the well bore at the well head so that the two end thereof can be threaded together and the string of tubular members projecting down into the well bore extended by such threaded addition.

SUMMARY AND ADVANTAGES OF THE INVENTION

The apparatus according to the invention permits a well casing to remain engaged with multiple rollers while still allowing the casing to swivel or turn about its axis, as it is being threadedly connected to a of section casing suspended in the well bore from the rig floor.

The apparatus automatically guides and positions a casing during a casing stabbing operation. A movable gripping arm assembly is movable relative to an axis of rotation of the casing. The movable gripping arm assembly has movable gripping arms for gripping and capturing the casing and surrounding the casing about its circumference.

A movable roller bracket assembly is supported by the gripping arm assembly and is movable with respect to the gripping arm assembly. The movable roller bracket assembly assists in the gripping and surrounding of the casing.

At least one actuator is provided for positioning the gripping arm assembly and the roller bracket assembly relative to one another in order to capture and grip the casing between the gripping arm assembly and the roller bracket assembly to thereby support and grip the casing on the circumference thereof from opposing diametric sides.

The movable gripping arm assembly includes a pair of movable gripping arms and an arm actuator for opening and closing the gripping arms relative to the circumference of the casing. At least one roller is rotatably mounted on each gripping arm. The roller is pressed against the circumference of the casing on a front diametric side thereof when the gripping arms are closed by the arm actuator and allowing for rotation of the casing relative to the gripping arms.

The movable roller bracket assembly includes a roller bracket disposed in between the movable gripping arms and a bracket actuator for moving the roller bracket linearly towards and away from the axis of the casing. The roller bracket has at least two rollers rotatably mounted on the roller bracket. The rollers are pressed against the circumference of the casing on a rear diametric side thereof when the roller bracket is moved toward the casing by the bracket actuator to thereby capture and support the casing between the roller bracket and the gripping arms. The rollers allow for rotation of the casing relative to the roller bracket.

The movable gripping arm assembly is mounted to a telescopic tube assembly, the telescopic tube assembly having at least two telescopic tubes which extend and retract along a substantially symmetrical center line of the of the telescopic tube assembly and a tube actuator attached to the telescopic tubes to positions the gripping arm assembly along the center line of the telescopic tube assembly, toward and away from the axis of the casing.

The apparatus further includes a mounting assembly for mounting the telescopic tube assembly to a structure such as a rig mast surrounding the casing.

The apparatus further includes a positioning mechanism connected to the mounting assembly and to the telescopic tube assembly for positioning the telescopic tube assembly relative to the structure from a generally horizontal working position to a generally vertical storage position.

The apparatus further includes a portable remote control for remotely controlling all movable elements of the apparatus.

BRIEF DESCRIPTION OF THE DRAWINGS

The preferred exemplary embodiments of the present invention are described in further detail below in conjunction with the accompanying drawings. In which.

DESCRIPTION OF THE PREFERRED EMBODIMENTS

Figure 1:
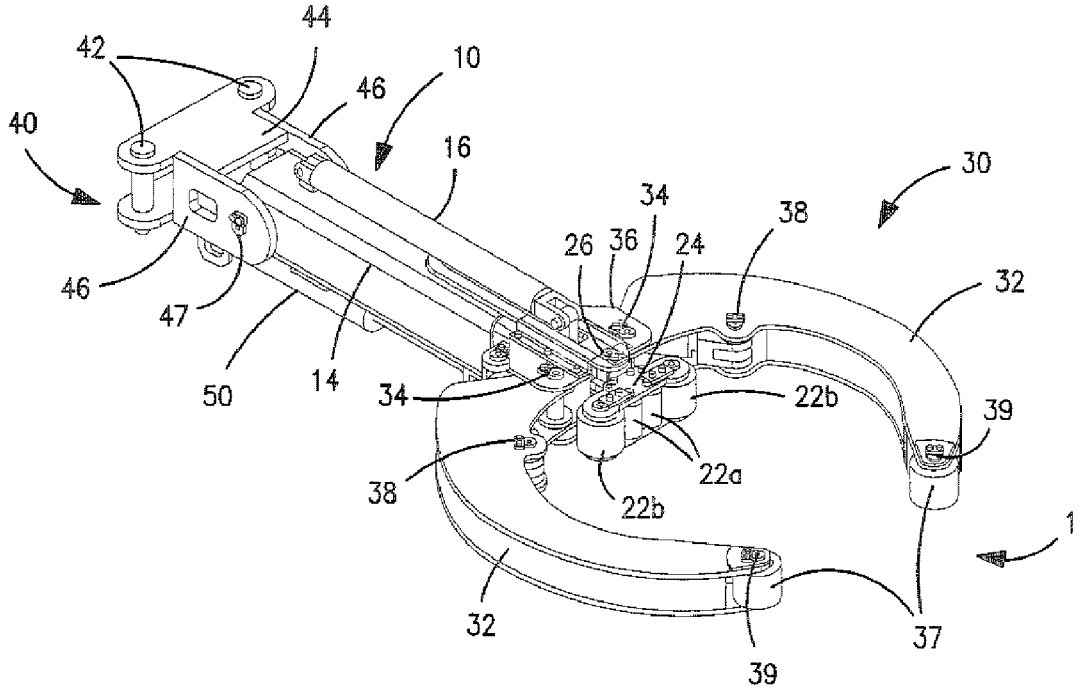
FIG. 1 is an isometric view of the automatic casing stabbing arm.

Referring now to FIGS. 1-6, the apparatus 1 for an automated casing stabbing arm according to the invention is shown. The apparatus 1 includes a telescopic tube assembly 10, a movable roller bracket assembly 20, a movable arm assembly 30, a mounting assembly 40, an apparatus actuator 50, and a PLC portable remote control device 5.

The apparatus 1 is shown installed on a rig's mast or derrick 2. In a working position, the apparatus 1 is oriented horizontally to provide radial support and guidance to a casing 3. A rig worker on the rig floor 4 controls the apparatus 1 by means of the portable remote control device 5.

The telescopic tube assembly 10 has at lease two telescopic tubes 12, 14. An inner tube 12 is disposed within an outer tube 14. The inner tube 12 is telescopically slidable relative to the outer tube 14 along substantially symmetrical a center line C-C, shown in FIG. 2, of the telescopic tube assembly 10. The inner tube 12 is driven by a tube actuator 16 which is attached to the inner tube 12 at a first end 16*a* thereof and to the outer tube 14 at a second end 16*b* thereof. The telescopic tube assembly 10 positions the entire movable arm assembly 30 in a direction along the center line C-C of the telescopic tubular assembly 10, towards the casing 3 to a casing support position. The arm assembly 30 is attached to the tube assembly 10, as will be described hereinafter. The tube actuator 16 is a linear actuator of a known type recognized in the field, therefore detailed explanation of such actuator is unnecessary.

Figure 2:
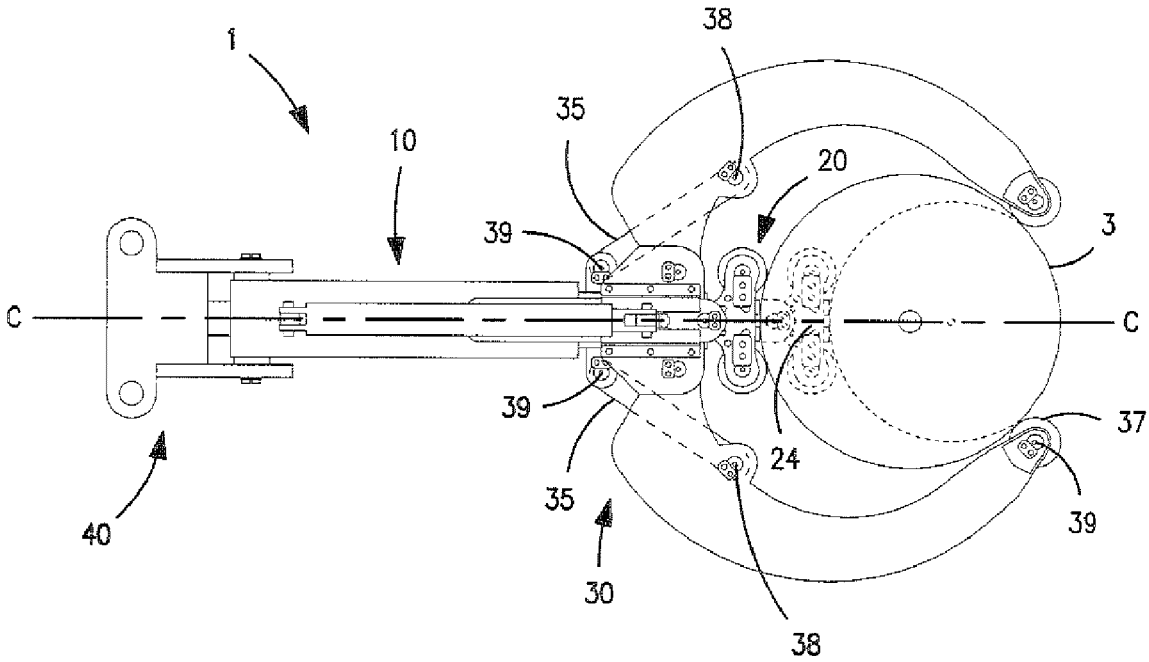
FIG. 2 is a plan view of the automatic casing stabbing arm.

The movable roller bracket assembly 20 has a plurality of rollers 22*a*, 22*b* for engaging a surface of the casing 3. The rollers 22*a*, 22*b* include an inner pair of rollers 22*a* and an outer pair of roller 22*b*. As depicted in FIGS. 1 and 2, the outer rollers 22*b* have a larger diameter than the inner rollers 22*b*. Each roller is rotatably mounted on a movable roller bracket 24. The roller bracket 24 is also pivotally connected through a bracket pin 26 and clevis 29 to a bracket actuator 27. The connection of the roller bracket 24 to the bracket actuator 27 through the clevis 29 allows for the entire roller bracket 24 to pivot relative to the center line C-C, to assist in capturing the casing 3 within the arm assembly, and also enables smooth rotation of the casing 3 within the apparatus 1 while being gripped. The bracket actuator 27 is disposed within the inner tube 12 of the tube assembly 10 and positions the roller bracket 27 in the direction the center line C-C of the telescopic tubular assembly 10. The movement of the roller bracket 24 by the bracket actuator 27 is depicted in phantom in FIG. 2, which shows the roller bracket 24 in two different positions along line C-C, accommodating and guiding two different casing sizes. The bracket actuator 27 is a linear actuator of a known type and further details thereof are therefore omitted.

The moveable arm assembly 30 includes a pair of arcuate gripping arms 32 pivotally connected either jointly with a single pin for both as or in the preferred embodiment shown with each arm 32 having a pivot pin 34 pivotally connecting each movable gripping arm 32 to an arm bracket 36 attached to the front or free end of the inner telescopic tube 12. Each arm 32 has at least one roller 37 rotatably mounted at the free end of each arm 32 on a concave inner side of the arcuate gripping arms 32 facing the casing 3, as seen in FIG. 2. Each roller 37 has a single pin 39 through a center line of the roller with minimal play with respect to the arm. The movable arm assembly further includes a pair of arm actuators 35 pivotally connected to each arm 32 at pivot pin 38 and to the outer tube 14 of the telescopic tubular assembly 10 at pivot pins 39 to open and close the gripping arms 32 during capturing of the casing 3, for instance when the tube actuator 16 is positioning the arm assembly 20 in the vicinity of the casing 3.

Furthermore, the gripping arms 32 may be closed or opened around the outer circumference of the casing 3 in order for the rollers 37 to engage differing casing sizes. It will be understood that with the combination of the movable arm assembly 30 and the movable roller bracket assembly 20, a variety of different casing diametric sizes are accommodated and rear engagement with the opposite side of the casing 3 is provided in addition to rollers 37 mounted on the pair of gripping arms 32. The arm actuators 35 are linear actuators of a known type and further details thereof are therefore omitted.

The mounting assembly 40 is provided to pivotally attach the telescopic tubular assembly 10 onto a structure on the rig's mast or derrick 2 for quick and easy installation of the apparatus 1. The mounting assembly 40 includes a pair of mounting pins 42 and a mounting bracket 44. The mounting bracket 44 has two horizontally extending flanges 46 which pivotally support the telescopic tube assembly 10 by means of attachment pins 47.

Figure 3:
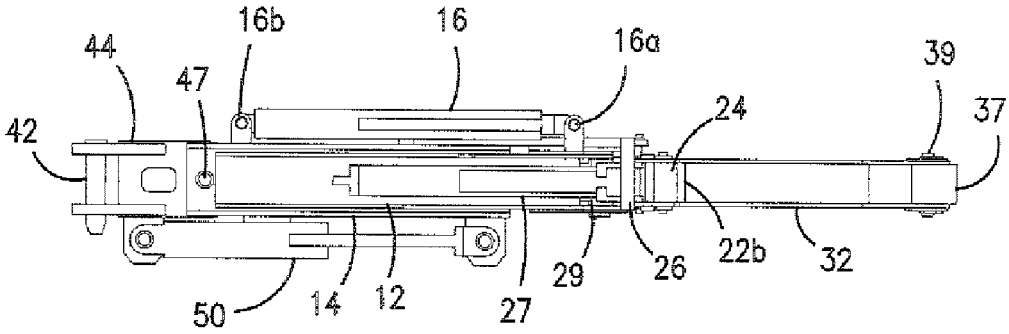
FIG. 3 is a side sectional view of the automatic casing stabbing arm.
Figure 4:
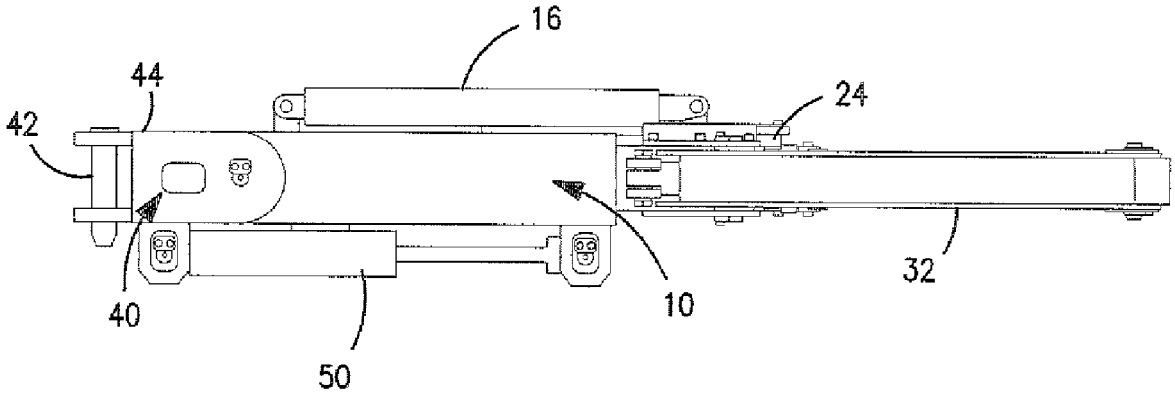
FIG. 4 shows the automatic casing stabbing arm in a horizontal working position.
Figure 5:
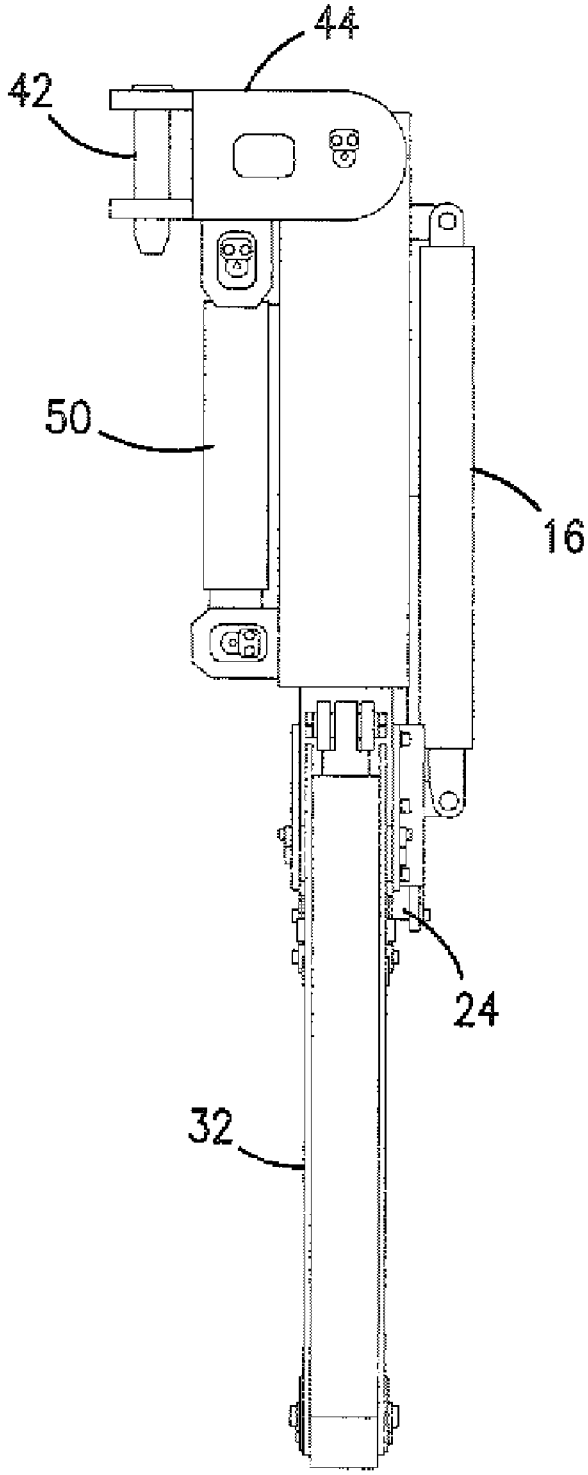
FIG. 5 shows the automatic casing stabbing arm in a vertical storage position.
Figure 6:
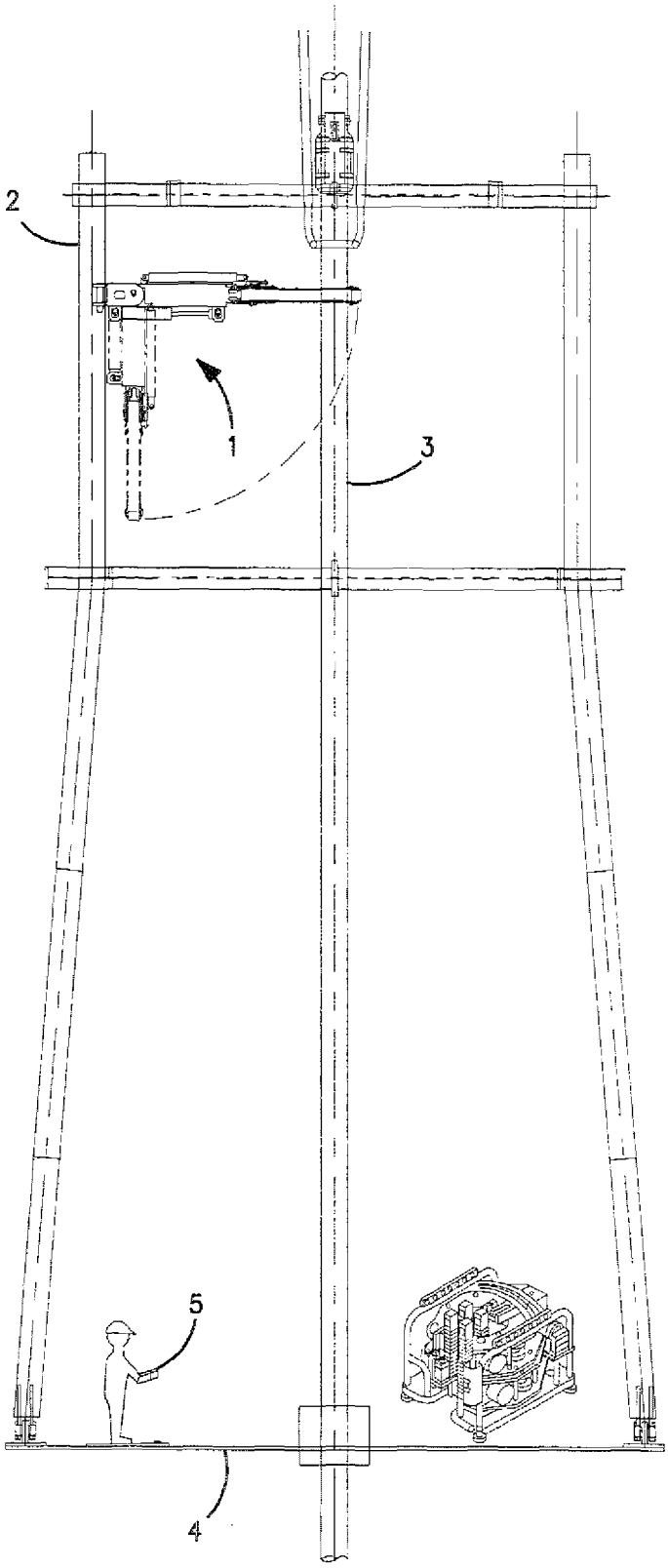
FIG. 6 depicts the automatic casing stabbing arm installed on the mast of a drilling rig and a portable remote control device on the rig floor.

An apparatus actuator 50 is attached to an underside of the mounting assembly 40 and the underside of the telescopic tube assembly 10 in a typical manner, as shown in FIG. 4, so as to rotate the telescopic tubular assembly 10 ninety degrees downward from the generally horizontal working position shown in FIGS. 3, 4 and 6, to the to vertical storage or parking position shown in FIGS. 5 and 6. In the preferred embodiment the apparatus 1 is pivoted downward to a generally vertical storage position. Upon further viewing of FIGS. 4 and 5, it will be seen that the apparatus actuator 50 is in an extended position when in the horizontal working position, and is in a retracted position when in the vertical parking position. The apparatus actuator 50 is a linear actuator of a know type and further details thereof are therefore omitted.

The foregoing relates to the preferred exemplary embodiment of the invention, it being understood that other variants and embodiments thereof are possible within the spirit and scope of the invention, the latter being defined by the appended claims.

I claim:

1. An apparatus for automatically guiding and positioning a rotatable drilling tubular during a stabbing operation of the drilling tubular, comprising:

a movable gripping arm means being movable relative to an axis of rotation of the drilling tubular along a center line, the gripping arm means having movable gripping arms gripping and capturing the drilling tubular and surrounding the drilling tubular about a circumference thereof;

a telescopic tube assembly actuatable along the centerline and supporting the gripping arm means;

a movable roller bracket means supported by the telescopic tube assembly, the roller bracket means being movable towards and away from the axis of rotation of the drilling tubular with respect to both the gripping arm means and the telescopic tube assembly along the center line to accommodate varying circumferences of the drilling tubular, regardless of whether the gripping arm means and the telescopic tube assembly are stationary or moving, the roller bracket means assisting in the gripping and surrounding of the drilling tubular by coming into contact with the circumference thereof; and at least one arm actuator means for positioning the gripping arms and at least one bracket actuator means for positioning the roller bracket means relative to the gripping arm means along the center line in order to capture and grip the drilling tubular between the gripping arm means and the roller bracket means which come in to contact with the drilling tubular to thereby guide and grip the drilling tubular on the circumference thereof from opposing diametric sides of the drilling tubular.

2. The apparatus according to claim 1, wherein the gripping arm means comprises a pair of said movable gripping arms and the arm actuator means are for opening and closing the gripping arms relative to the circumference of the drilling tubular, the gripping arm means further comprising at least one roller rotatably mounted on each of the gripping arms, the at least one roller of the gripping arm means being pressed against the circumference of the drilling tubular on a front diametric side thereof when the gripping arms are closed by the arm actuator means, the at least one roller of the gripping arm means allowing for rotation of the drilling tubular relative to the gripping arms.

3. The apparatus according to claim 2, wherein the movable roller bracket means comprises a roller bracket disposed in between the movable gripping arms, a bracket actuator moving the roller bracket linearly towards and away from the axis of rotation of the drilling tubular, the roller bracket having at least one roller rotatably mounted on the roller bracket, the at least one roller of the roller bracket being pressed against the circumference of the drilling tubular on a rear diametric side thereof when the roller bracket is moved toward the drilling tubular by the bracket actuator to thereby capture and guide the drilling tubular between the roller bracket and the gripping arms, the at least one roller of the roller bracket allowing for rotation of the drilling tubular relative to the roller bracket.

4. The apparatus according to claim 3, wherein the roller bracket is pivotally connected to the telescopic tube assembly by a pin, thereby allowing for pivotal movement of the roller bracket relative to the center line.

5. The apparatus according to claim 3, wherein the gripping arm means includes an arm actuator pivotally connected at one end thereof one of the gripping arms by a pivot pin and at a second end thereof to the telescopic tube assembly by a pivot pin.

6. The apparatus according to claim 2, wherein at least one roller of the gripping arm is rotatably mounted at a free end of each of the gripping arms by a fixed pin.

7. The apparatus according to claim 2, wherein each of said gripping arms is pivotally attached to the telescopic tube assembly by a pin.

8. The apparatus according to claim 2, wherein the gripping arm means includes an arm actuator pivotally connected at one end thereof one of the gripping arms by a pivot pin and at a second end thereof to the telescopic tube assembly by a pivot pin.

9. The apparatus according to claim 1, wherein the movable roller bracket means comprises a roller bracket disposed in between the movable gripping arms, a bracket actuator moving the roller bracket linearly towards and away from the axis of rotation of the drilling tubular, the roller bracket having at least one roller rotatably mounted on the roller bracket, the at least one roller of the roller bracket being pressed against the circumference of the drilling tubular on a rear diametric side thereof when the roller bracket is moved toward the drilling tubular by the bracket actuator to thereby capture and guide the drilling tubular between the roller bracket and the gripping arms, the at least one roller of the roller bracket allowing for rotation of the drilling tubular relative to the roller bracket.

10. The apparatus according to claim 9, wherein the roller bracket is pivotally connected to the telescopic tube assembly by a pin, thereby allowing for pivotal movement of the roller bracket relative to the center line.

11. The apparatus according to claim 9, wherein the gripping arm means includes an arm actuator pivotally connected at one end thereof one of the gripping arms by a pivot pin and at a second end thereof to the telescopic tube assembly by a pivot pin.

12. The apparatus according to claim 1, wherein the gripping arm means is mounted to the telescopic tube assembly, the telescopic tube assembly having at least two telescopic tubes which extend and retract along a substantially symmetrical center line of the telescopic tube assembly, and a tube actuator means attached to the telescopic tubes for positioning the gripping arm means along the center line of the telescopic tube assembly, toward and away from the axis of rotation of the drilling tubular.

13. The apparatus according to claim 12, further comprising a mounting means for mounting the telescopic tube assembly to a structure surrounding the drilling tubular.

14. The apparatus according to claim 13, further comprising a positioning means connected to the mounting means and to the telescopic tube assembly for positioning the telescopic tube assembly relative to the structure from a generally horizontal working position to a generally vertical storage position.

15. The apparatus according to claim 1, further comprising a portable remote control means for remotely controlling all movable elements of the apparatus.

16. The apparatus according to claim 1, further comprising a positioning means to position the apparatus from a generally horizontal working position to a generally vertical storage position.

17. The apparatus according to claim 1, wherein the gripping arm means includes an arm actuator pivotally connected at one end thereof one of the gripping arms by a pivot pin and at a second end thereof to the telescopic tube assembly by a pivot pin.

18. The apparatus according to claim 1, wherein the gripping arm means further comprises a pair of said movable gripping arms and the arm actuator means are for opening and closing the gripping arms relative to the circumference of the drilling tubular, the gripping arms being pressed against the circumference of the drilling tubular on a front diametric side thereof when the gripping arms are closed by the arm actuator means, while allowing for rotation of the drilling tubular relative to the gripping arms.

19. The apparatus according to claim 1, wherein a drilling tubular is a drilling pipe, a casing, or tubular stock.

* * * * *